US009920966B2

(12) United States Patent
Kim et al.

(10) Patent No.: US 9,920,966 B2
(45) Date of Patent: Mar. 20, 2018

(54) APPARATUS AND METHOD FOR INCREASING REMOVAL RATE OF RESIDUE

(71) Applicant: Hyundai Motor Company, Seoul (KR)

(72) Inventors: Han Seok Kim, Gyeonggi-Do (KR); Jong Rae Cho, Gyeonggi-Do (KR); Dae Sung Jung, Gyeonggi-Do (KR)

(73) Assignee: Hyundai Motor Company, Seoul (KR)

( * ) Notice: Subject to any disclaimer, the term of this patent is extended or adjusted under 35 U.S.C. 154(b) by 515 days.

(21) Appl. No.: 14/579,110

(22) Filed: Dec. 22, 2014

(65) Prior Publication Data

US 2016/0102899 A1 Apr. 14, 2016

(30) Foreign Application Priority Data

Oct. 10, 2014 (KR) ..... 10-2014-0136646

(51) Int. Cl.
*F25B 47/00* (2006.01)
*F25B 43/02* (2006.01)
*F25B 45/00* (2006.01)

(52) U.S. Cl.
CPC ..... *F25B 43/02* (2013.01); *F25B 45/00* (2013.01); *F25B 2345/002* (2013.01)

(58) Field of Classification Search
CPC ..... F25B 43/02; F25B 45/00; F25B 43/006; F25B 43/043
USPC ..... 62/470
See application file for complete search history.

(56) References Cited

U.S. PATENT DOCUMENTS 5,040,382 A * 8/1991 Abraham ..... F25B 43/02 62/149
5,127,232 A * 7/1992 Paige ..... F25B 45/00 62/149
5,442,930 A * 8/1995 Stieferman ..... F25B 45/00 62/149
5,551,253 A * 9/1996 Kim ..... F25B 31/004 55/326
6,185,955 B1 * 2/2001 Yamamoto ..... C09K 5/041 62/470
6,237,362 B1 5/2001 Jang
6,263,695 B1 * 7/2001 Renders ..... B01D 1/02 62/292

(Continued)

FOREIGN PATENT DOCUMENTS

JP H06-33920 B2 5/1994
JP H09-229521 A 9/1997

(Continued)

*Primary Examiner* — David Teitelbaum
(74) *Attorney, Agent, or Firm* — Mintz Levin Cohn Ferris Glovsky and Popeo, P.C.; Peter F. Corless

(57) ABSTRACT

An apparatus and a method of removing a high boiling point residue from a waste refrigerant are provided to improve a reuse rate of the waste refrigerant by improving an oil removal rate at which oil is separated from the waste refrigerant. The apparatus includes a vaporizer that is configured to vaporize a waste refrigerant collected from a vehicle and includes an oil outlet configured to exhaust oil separated from the waste refrigerant. In addition, an oil separator is configured to receive the vaporized waste refrigerant transferred from the vaporizer and separate oil mists remaining in the waste refrigerant from the waste refrigerant.

8 Claims, 4 Drawing Sheets

(56) References Cited

U.S. PATENT DOCUMENTS

| | | | | |
|---|---|---|---|---|
| 8,225,618 | B2 * | 7/2012 | Boyd | F04B 41/06 62/292 |
| 2003/0196450 | A1 * | 10/2003 | Higami | B60H 1/00585 62/475 |
| 2004/0089018 | A1 | 5/2004 | Okaza et al. | |

FOREIGN PATENT DOCUMENTS

| | | | |
|---|---|---|---|
| JP | H11281211 | A | 10/1999 |
| JP | 2004-125295 | A | 4/2004 |
| JP | 3874980 | B2 | 1/2007 |
| JP | 2014-085082 | A | 5/2014 |
| KR | 10-2001-0066749 | | 7/2001 |
| KR | 10-0398123 | | 9/2003 |
| KR | 10-2003-0081454 | | 10/2003 |
| KR | 10-1380711 | | 4/2014 |

* cited by examiner

APPARATUS AND METHOD FOR INCREASING REMOVAL RATE OF RESIDUE

CROSS-REFERENCE TO RELATED APPLICATION

This application is based on and claims the benefit of priority to Korean Patent Application No. 10-2014-0136646, filed on Oct. 10, 2014 in the Korean Intellectual Property Office, the disclosure of which is incorporated herein in its entirety by reference.

TECHNICAL FIELD

The present disclosure relates to an apparatus and a method of removing a high boiling point residue from a waste refrigerant, and more particularly, to an apparatus and a method of removing a high boiling point residue from a waste refrigerant to improve a removal rate of oil present in the waste refrigerant collected from a vehicle.

BACKGROUND

Today, efforts are being increased globally for reducing greenhouse gas due to global warming, and reduction of the greenhouse gas has been promoted through a target management system and emissions trading globally. A refrigerant (HFC134a) for a vehicle has a global warming potential 1340 times greater than that of carbon dioxide. Therefore, a method of processing refrigerants of disused vehicles that have been increased every year is required.

According to a standard (KSI 3004) of the Korean Agency for Technology and Standards, six physical property standards should be satisfied to reuse refrigerants. Among them, a reuse standard of an evaporation residue is 0.01% or less. However, acidity or moisture may be removed using a filter, or the like, while a high boiling point evaporation residue may not be removed. Particularly, since tens of grams of oil are injected together with refrigerants, they are collected together with the refrigerants during the collection of refrigerants of all vehicles.

The following Table 1 shows measurement results of contents of oil in refrigerants collected from a junkyard. Since waste refrigerants contain a substantial amount of oil due to characteristics thereof, even though a heat exchanger according to the related art for removing the oil has been installed in a refrigerant collector, contents of oil as shown in the following Table 1 were confirmed. These numeral values are numeral values greater than 0.01%, which is the reuse standard of the evaporation residue, and it may be difficult to reuse the waste refrigerants due to the oil contained therein, which is the high boiling point evaporation residue.

TABLE 1

| Waste Refrigerant | A | B | C | D | E | F | G |
|---|---|---|---|---|---|---|---|
| Content (%) of Oil | 8.8 | 2.8 | 26.8 | 7.9 | 3.9 | 2.0 | 9.5 |

SUMMARY

The present disclosure provides an apparatus and a method of removing a high boiling point residue from a waste refrigerant to improve a reuse rate of the waste refrigerant by improving a removal rate at which oil remaining in the waste refrigerant collected from a vehicle is separated from the waste refrigerant.

According to an exemplary embodiment of the present disclosure, an apparatus of removing a high boiling point residue from a waste refrigerant may include: a vaporizer configured to vaporize a waste refrigerant collected from a vehicle and may include an oil outlet configured to exhaust oil separated from the waste refrigerant; and an oil separator configured to receive the vaporized waste refrigerant transferred from the vaporizer and separate oil mists remaining in the waste refrigerant from the waste refrigerant.

According to another exemplary embodiment of the present disclosure, a method of removing a high boiling point residue from a waste refrigerant may include: separating oil from a waste refrigerant collected from a vehicle by vaporizing the waste refrigerant; and separating oil mists remaining in the vaporized waste refrigerant from the waste refrigerant.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

An exemplary embodiment of the present disclosure will be described in detail with reference to the accompanying drawings.

Figure 1:
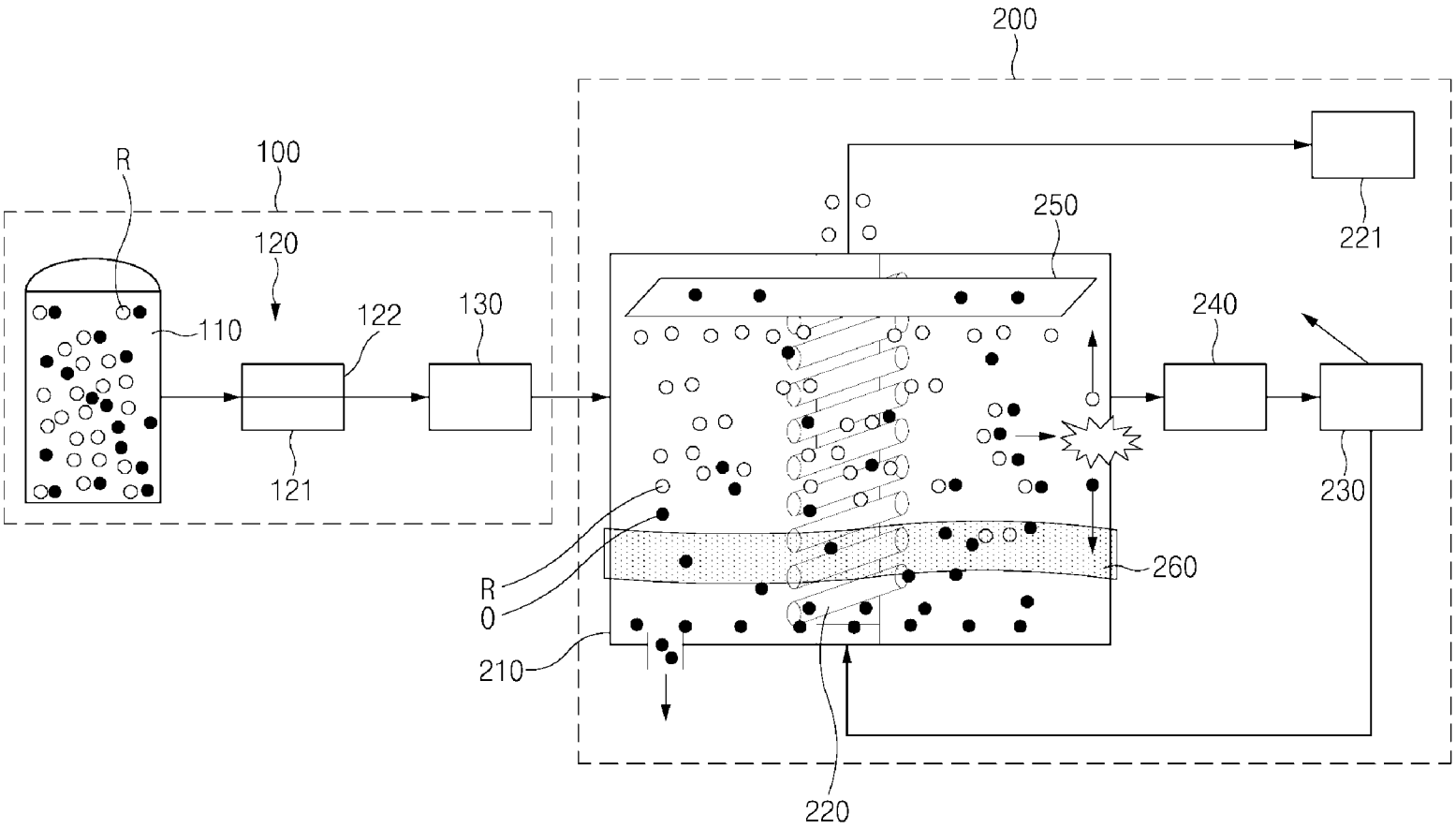
FIG. 1 is an exemplary schematic view of an apparatus of removing a high boiling point residue from a waste refrigerant according to an exemplary embodiment of the present disclosure.

As shown in FIG. 1, an apparatus of removing a high boiling point residue from a waste refrigerant according to an exemplary embodiment of the present disclosure may include a vaporizer 100 configured to vaporize a waste refrigerant R collected from a vehicle and may include an oil outlet 121 configured to exhaust oil separated from the waste refrigerant R; and an oil separator 200 configured to separate the vaporized waste refrigerant R transferred from the vaporizer 100 and separate oil mists O remaining in the waste refrigerant R from the waste refrigerant R.

When a vaporizer that has been used in the related art is used as the vaporizer 100, the oil may be accumulated in the vaporizer 100, causing the performance of the vaporizer 100 to deteriorate and a content of oil to increase during the vaporization of the waste refrigerant R. Therefore, the oil outlet 121 may be formed in the vaporizer 100 to exhaust the oil separated from the waste refrigerant R to the exterior. The vaporizer 100 according to an exemplary embodiment of the present disclosure may include a waste refrigerant collecting vessel 110 that has the waste refrigerant R collected from the vehicle and stored therein, a body 120 having the waste refrigerant R introduced from the waste refrigerant collecting vessel 110 thereinto and having the oil outlet 121 formed at a lower portion thereof, and a waste refrigerant compressor 130 configured to compress the vaporized waste refrigerant R and inject the compressed waste refrigerant R into the oil separator 200.

The vaporizer 100 may further include a heating device 122 disposed within the body 120 and configured to heat the waste refrigerant R introduced into the body 120. The waste refrigerant compressor 130 may be configured to spray the compressed waste refrigerant R toward an inner wall surface of the oil separator 200, more specifically, an inner wall surface of an accommodation vessel 210 to be described below. The waste refrigerant R sprayed through the waste refrigerant compressor 130 may contact the inner wall surface of the oil separator 200, more specifically, an inner wall surface of an accommodation vessel 210 to be described below to separate the oil mists O.

The oil separator 200 may include an accommodation vessel 210 having the waste refrigerant R introduced from the vaporizer 100 thereinto, a coil pipe 220 disposed perpendicularly at the substantial center of the accommodation vessel 210, and a compressor 230 configured to compress the waste refrigerant R and inject the compressed waste refrigerant R from the accommodation vessel 210 into the coil pipe 220. The accommodation vessel 210 may include a filter 240 disposed between the accommodation vessel 210 and the compressor 230 to filter moisture and dust remaining in the waste refrigerant R, a mesh 250 disposed at an inner side thereof to adsorb the oil mists O from the waste refrigerant R, and a heating band 260 disposed at an outer side thereof to heat the waste refrigerant R.

The mesh 250 may be disposed at an upper end of the inner side of the accommodation vessel 210 and may be configured to prevent light oil mists O from being leaked together with the vaporized waste refrigerant R to the exterior of the accommodation vessel 210. The heating band 260 may be configured to apply heat from the outer side of the accommodation vessel 210 to the inner side thereof to induce a heat exchange allowing the waste refrigerant R to be vaporized and the oil mists O to be liquefied to be additionally generated in the accommodation vessel 210.

The coil pipe 220 may include an external storage 221 disposed at the outer side of the accommodation vessel 210 and may be configured to store the waste refrigerant R introduced into the coil pipe 220 through the compressor 230 therein. The compressor 230 may be manufactured in an oil-less type in which oil is not exposed at a portion that contacts the waste refrigerant R. Accordingly, the oil may be prevented from being mixed with the refrigerant passing through the compressor 230. The apparatus of removing a high boiling point residue from a waste refrigerant R according to an exemplary embodiment of the present disclosure configured as described above may be configured to remove the oil contained in the waste refrigerant R based on a flow chart shown in FIG. 2.

Figure 2:
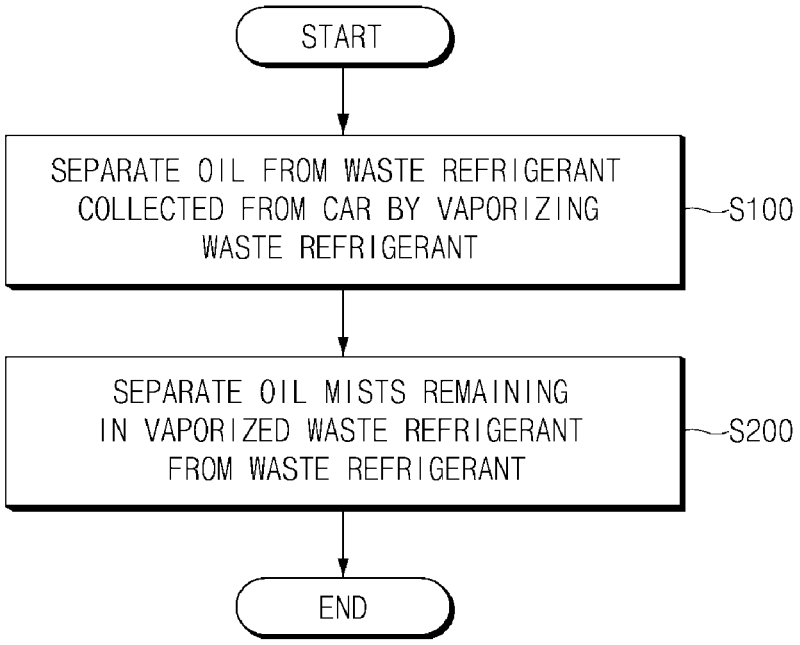
FIG. 2 is an exemplary flow chart of a method of removing a high boiling point residue from a waste refrigerant according to an exemplary embodiment of the present disclosure.
Figure 3:
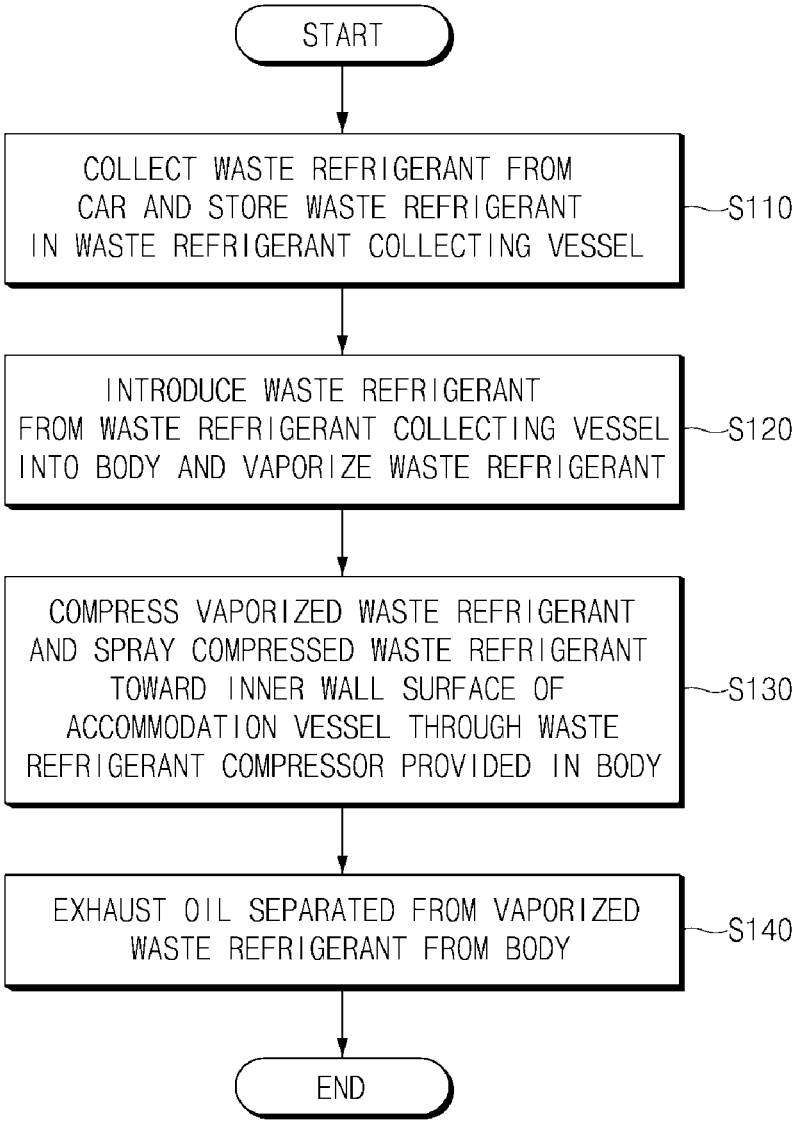
FIG. 3 is another exemplary flow chart of a method of removing a high boiling point residue from a waste refrigerant according to an exemplary embodiment of FIG. 2.
Figure 4:
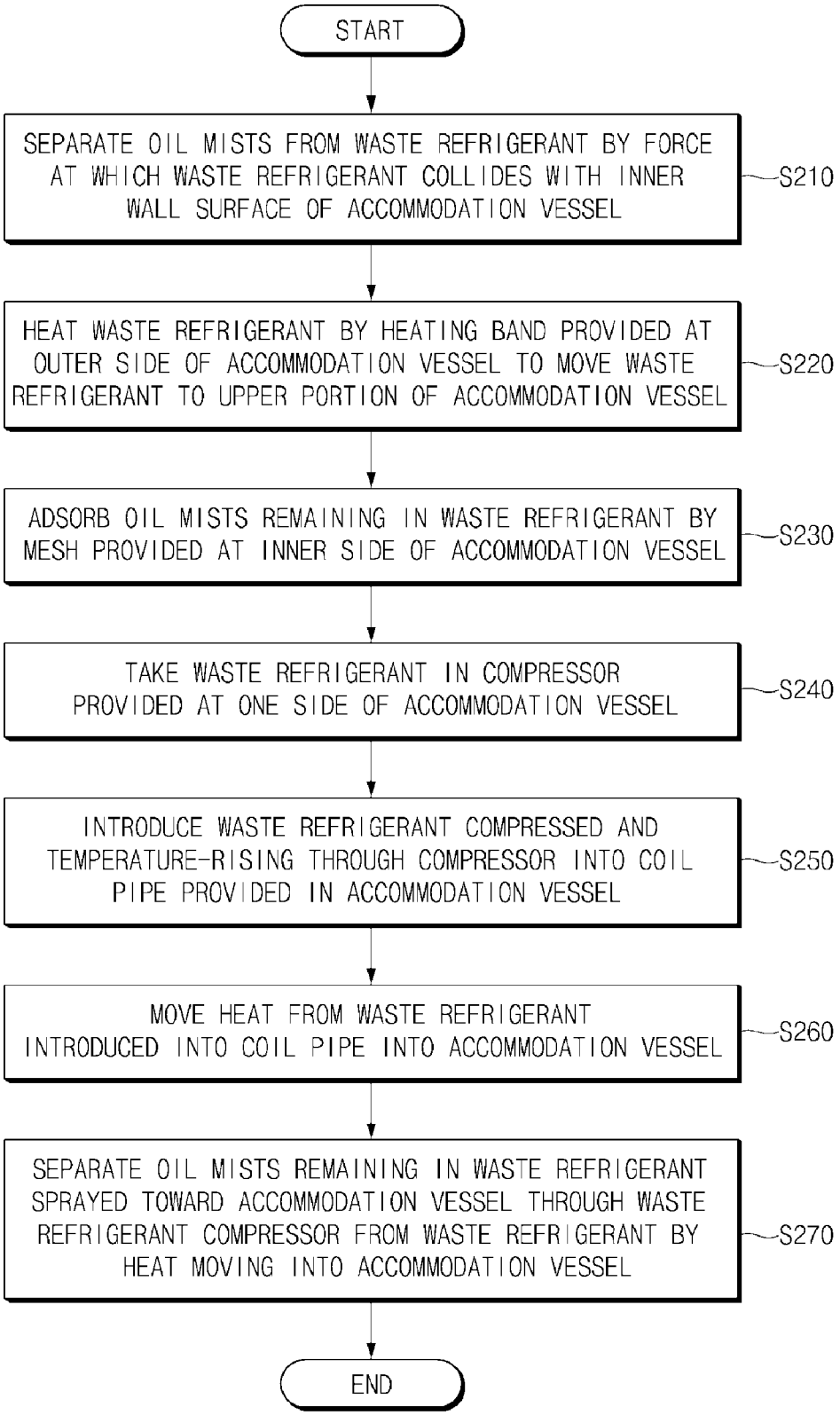
FIG. 4 is another exemplary flow chart of a method of removing a high boiling point residue from a waste refrigerant according to an exemplary embodiment of FIG. 2.

As shown in FIGS. 2 to 4, a method of removing a high boiling point residue from a waste refrigerant R according to an exemplary embodiment of the present disclosure may include a step (S100) of separating the oil from the waste refrigerant R collected from the vehicle by vaporizing the waste refrigerant R, and a step (S200) of separating the oil mists remaining in the vaporized waste refrigerant R from the waste refrigerant R.

The step (S100) of separating the oil from the waste refrigerant R collected from the vehicle by vaporizing the waste refrigerant R will be described in more detail below. The waste refrigerant R may be collected from the vehicle and may be stored in the waste refrigerant collecting vessel 110 (S110). The waste refrigerant R may be introduced from the waste refrigerant collecting vessel 110 into the body 120 and may be vaporized (S120). The vaporized waste refrigerant R may be compressed and sprayed toward the inner wall surface of the accommodation vessel 210 disposed in the oil separator 200 through the waste refrigerant compressor 130 disposed within the body 120 (S130). Then, the oil separated from the vaporized waste refrigerant R may be exhausted to the exterior of the body 120 through the oil outlet 121 disposed in the body 120 (S140).

The step (S200) of separating the oil mists remaining in the vaporized waste refrigerant R from the waste refrigerant R will be described in more detail below. The oil mists may be separated from the waste refrigerant R by force at which the waste refrigerant R collides with the inner wall surface of the accommodation vessel 210 (S210). The waste refrigerant R may be heated by the heating band 260 disposed at the outer side of the accommodation vessel 210 to move to an upper portion of the accommodation vessel 210 (S220), and the oil mists O remaining in the waste refrigerant R may be adsorbed by the mesh disposed at an inner side of an upper portion of the accommodation vessel 210 (S230).

In addition, the waste refrigerant R may be taken in the compressor 230 disposed at one side of the accommodation vessel 210 (S240). The waste refrigerant R compressed and temperature increasing through the compressor 230 may be introduced into the coil pipe 220 disposed within the accommodation vessel 210 (S250). Heat may move from the waste refrigerant R introduced into the coil pipe 220 into the accommodation vessel 210 (S260), and the oil mists O remaining in the waste refrigerant R sprayed toward the accommodation vessel 210 through the waste refrigerant compressor 130 may be separated from the waste refrigerant R by the heat moving into the accommodation vessel 210 (S270). In particular, the heat moving from the coil pipe 220 into the accommodation vessel 210 may induce the heat exchange allowing the waste refrigerant R to be vaporized and the oil mists O to be liquefied to be additionally generated in the accommodation vessel 210. Meanwhile, the waste refrigerant R introduced into the coil pipe 220 and exhausting the heat into the accommodation vessel 210 may be stored in an external vessel disposed at the outer side of the accommodation vessel 210.

Meanwhile, the following Table 2 shows contents of oil in the waste refrigerant R when the apparatus and the method of removing a high boiling point residue from a waste refrigerant R according to an exemplary embodiment of the present disclosure are applied and when the apparatus and the method of removing a high boiling point residue from a waste refrigerant R according to an exemplary embodiment of the present disclosure are not applied.

TABLE 2

| No. | % after application | % before application |
|---|---|---|
| 1 | 0.009 | 8.8 |
| 2 | 0.01 | 3.9 |
| 3 | 0.01 | 7.8 |

The above table 2 shows that when the method of removing a high boiling point residue from a waste refrigerant R according to an exemplary embodiment of the present disclosure is applied, a content of evaporation residue such as oil, or the like, satisfies 0.01% or less when the method is not applied, which is a reuse standard of the waste refrigerant R. In addition, in accordance with improvement of the present disclosure, it may be expected that a content (0.001%) of evaporation residue corresponding to a new refrigerant standard, which is an evaporation residue allowable value contained in the refrigerant, may also be satisfied.

As set forth above, with the apparatus and the method of removing a high boiling point residue from a waste refrigerant according to an exemplary embodiment of the present disclosure, an oil removal rate at which the oil is separated from the waste refrigerant may be improved to thus improve a reuse rate of the waste refrigerant.

In addition, during the improvement of the reuse rate of the waste refrigerant, a refrigerant processing (disuse) cost may be decreased, and a reuse refrigerant may be sold to create revenue. Further, a standard (0.01%) of an evaporation residue for reusing the refrigerant may be accomplished. In addition, an improved oil rate may be accomplished through a simplified configuration and thus, a wide space for installation is not required, and the oil may be separated from the waste refrigerant through a simplified process.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. An apparatus for removing a high boiling point residue from a waste refrigerant, comprising:

a vaporizer configured to vaporize a waste refrigerant collected from a vehicle and includes an oil outlet configured to exhaust oil separated from the waste refrigerant; and an oil separator configured to receive the vaporized waste refrigerant transferred from the vaporizer and separate oil mists remaining in the vaporized waste refrigerant from the vaporized waste refrigerant, wherein the oil separator includes:

an accommodation vessel into which the vaporized waste refrigerant is introduced from the vaporizer;

a coil pipe perpendicularly disposed at substantially a center of the accommodation vessel; and a compressor configured to compress the vaporized waste refrigerant and inject the vaporized waste refrigerant from the accommodation vessel into the coil pipe, and wherein the vaporizer includes:

a waste refrigerant compressor configured to compress the vaporized waste refrigerant and spray the vaporized waste refrigerant into the accommodation vessel so as to collide with an inner wall surface of the accommodation vessel.

2. The apparatus according to claim 1, wherein the vaporizer further includes:

a waste refrigerant collecting vessel configured to collect the waste refrigerant collected from the vehicle; and a body having the waste refrigerant introduced from the waste refrigerant collecting vessel thereinto and having the oil outlet formed at a lower portion thereof.

3. The apparatus according to claim 2, wherein the vaporizer further includes:

a heating device disposed within the body and configured to heat the waste refrigerant introduced into the body.

4. The apparatus according to claim 1, wherein the oil separator further includes a filter disposed between the accommodation vessel and the compressor and configured to filter moisture and dust remaining in the vaporized waste refrigerant.

5. The apparatus according to claim 1, wherein the accommodation vessel includes a mesh disposed at an inner side thereof and configured to absorb the oil mists from the vaporized waste refrigerant.

6. The apparatus according to claim 1, wherein the accommodation vessel includes a heating band disposed at an outer side thereof and configured to heat the vaporized waste refrigerant.

7. The apparatus according to claim 1, wherein the coil pipe includes an external storage disposed at an outer side of the accommodation vessel and configured to store the waste refrigerant introduced into the coil pipe through the compressor therein.

8. The apparatus according to claim 1, wherein the compressor is manufactured as an oil-less type to prevent oil from being exposed at a portion that contacts the vaporized waste refrigerant.

* * * * *